United States Patent [19]

Carlow

[11] 4,164,291

[45] Aug. 14, 1979

[54] SORTING APPARATUS

[75] Inventor: Charles A. Carlow, Edinburgh, Scotland

[73] Assignee: National Research Development Corporation, London, England

[21] Appl. No.: 815,304

[22] Filed: Jul. 13, 1977

[30] Foreign Application Priority Data

Jul. 16, 1976 [GB] United Kingdom ..... 29770/76

[51] Int. Cl.[2] ..... B07C 9/00

[52] U.S. Cl. ..... 414/136; 209/565; 209/942

[58] Field of Search ..... 209/71, 72, 122, 123, 209/125, 126, 73, 74 R, 74 M, 509, 559, 565, 942, 702, 703; 214/11 R, 11 A, 11 C

[56] References Cited

U.S. PATENT DOCUMENTS

| | | | |
|---|---|---|---|
| 2,108,869 | 2/1938 | Sandmeyer | 209/125 |
| 3,894,633 | 7/1975 | Egan et al. | 209/123 |
| 4,051,952 | 10/1977 | Hauptmann et al. | 209/126 X |

FOREIGN PATENT DOCUMENTS

| | | | |
|---|---|---|---|
| 647623 | 11/1928 | France | 209/126 |

*Primary Examiner*—Joseph J. Rolla

*Attorney, Agent, or Firm*—Oblon, Fisher, Spivak, McClelland & Maier

[57] ABSTRACT

Sorting apparatus comprises a locating device for defining an array of selectable sites and for generating for each site (when selected) a signal or signals identifying that site, a conveyer for conveying objects to be sorted past the array of sites and, a separator for separating selected and unselected objects. The locating device includes a movable selector member for use by an operator to select objects as they pass the array of sites. Preferably the array of sites is defined by a matrix of sets of orthogonal coils for receiving electrical signals transmitted by the selector member, and preferably the conveying device conveys the objects to be sorted over the matrix of orthogonal coils. The separator is connected to an output of the locating device for actuating the separator in dependence upon site-identifying signals generated by the locating device.

22 Claims, 15 Drawing Figures

SORTING APPARATUS

The present invention relates to sorting apparatus.

In many materials handling processes there is a requirement for a human operator to sort objects into two or more categories while the objects are being conveyed past the operator. The simplest example is an operator removing unwanted objects from a conveyor belt and leaving the wanted objects on the belt. For example stones may be separated from potatoes in this way on a potato harvester, or blemished fruit separated from good fruit. Another example is examination of eggs known as egg candling.

There are also known fully automatic systems for separating selected objects from unselected objects, for example a mixture of potatoes, stones and earth clods may be conveyed through an array of X-ray beams and the differences in attenuation caused by the potatoes and the waste matter may be detected by a bank of detector cells. The mixture may then be fed over the end of a conveyor belt to fall past an array of deflector fingers actuated under the control of the outputs of the detector cells.

It is one object of the present invention to provide a sorting apparatus to assist a human operator in the task of separating selected objects from unselected objects.

According to the present invention there is provided sorting apparatus comprising locating means for defining an array of selectable sites and for generating for each site when selected a signal or signals identifying that site, conveying means for conveying past the array of sites objects to be sorted by selection by an operator, separating means for separating selected and unselected objects, the locating means including a movable selector member for selecting objects as they pass the array of sites by causing site-identifying signals to be generated in respect of sites corresponding to the objects selected, the separating means being connected to an output of the locating means for actuating the separating means in dependence upon site identifying signals generated by the locating means.

The locating means may include a plurality of coils for receiving electrical signals transmitted by the selector member, the coils being positioned in the region of the conveying means and being arranged to define the said array of sites. In a preferred arrangement, the coils are arranged in a matrix of sets of orthogonal coils defining the array of sites by the intersections of the orthogonal coils, the matrix comprising longitudinal coils arranged along the general direction of movement of the conveying means, and transverse coils arranged across the general direction of movement of the conveying means. Thus for example the identifying signal for each site may be determined by the coil signal with the greatest amplitude from one set of coils and the coil signal with the greatest amplitude from the other set of coils. In other arrangements the coils may be powered and the selector member may pick off the identifying signals from the coils. Furthermore, the energising of the coils or the selector member may be electrostatic or electromagnetic. Also alternatively the sites may be defined by a plurality of coils one being individual to each site, in place of the sets of orthogonal coils.

Where, as in preferred arrangements, the array of sites is defined by a matrix of sets of orthogonal coils, the matrix of coils may include a plurality of sets of transverse coils, the transverse coils of different sets being staggered in position along the general direction of movement of the conveying means.

In a preferred arrangement the matrix of coils may include two sets of transverse coils, the transverse coils of one set being displaced relative to the transverse coils of the other set along the general direction of travel of the conveying means by half a pitch of the transverse coils of one set. The locating means may include switching means for rendering different sets of coils active to produce output signals at different times in a regularly recurring sequence, and, where two sets of transverse coils are provided, the switching means may be arranged to render the two sets of transverse coils active alternately with a period of alternation equal to the period of movement of the conveying means past successive transverse coils of one set of transverse coils.

The locating means may include delay means for delaying output signals from the transverse coils of one of the sets of transverse coils relative to output signals from other transverse coils, and for combining output signals from transverse coils of different sets of transverse coils. Where two sets of transverse coils are provided the delay means may be arranged to delay the output signals from the coils of the leading set of transverse coils relative to the output signals of the coils of the lagging set of transverse coils by half the period of movement of the conveying means past successive transverse coils of one set of transverse coils. In one such arrangement the delay means may include at least one shift register and the delay may be produced by feeding output signals from a coil of the leading set of transverse coils into a serial input of a shift register and by feeding output signals from a corresponding coil of the lagging set of transverse coils into a preset input of the shift register.

Where a matrix of sets of orthogonal coils is provided, the conveying means preferably includes dividing means defining a plurality of succeeding transverse rows across the conveying means having a spacing equal to the spacing of the transverse coils or, where the transverse coils are arranged in sets, equal to the spacing of transverse coils of the same set, the dividing means being adapted to position the objects to be sorted in transverse rows across the conveying means. The conveying means also preferably includes dividing means defining a plurality of channels running along the length of the conveying means and positioned in register with the longitudinal coils of the coil matrix, the longitudinal dividing means being adapted to position the objects to be sorted over and in register with the longitudinal coils. A single dividing means may be provided to effect the division into transverse rows and longitudinal channels, or different dividing means may be provided to effect the two functions.

Conveniently the conveying means may be arranged to convey the objects over the plurality of coils.

Also conveniently the separating means may be spaced from the array of selectable sites and the conveying means may be arranged to convey the objects to be sorted from the array of sites to the separating means. In such arrangements the locating means conveniently includes a memory device for storing information concerning a selected object when the object passes the array of sites and for presenting this information again after an appropriate delay when the object reaches the separating means, the locating means being arranged to utilise the stored information to control the separating means after the said delay. The said memory device may comprise at least one shift register, or may comprise a random-access memory.

The said memory device conveniently comprises at least one shift register connected to be shifted in synchronism with the movement of the conveying means past the transverse coils of the coil matrix and connected to receive at different preset inputs of the stages of the shift register input signals derived from different transverse coils of the matrix of coils. Also conveniently the locating means may include a plurality of shift registers arranged with at least one shift register associated with each of the longitudinal coils of the matrix, and entry control means for controlling entry of information into the shift registers in dependence upon output signals derived from the longitudinal coils.

The selector member may comprise a rod-like member adapted to be hand held for indicating selected objects. The locating means may be arranged to be actuated by operation of a pressure switch on the selector member.

The separating means may comprise a bank of ejector members positioned beneath the conveying means and arranged to project through the conveying means when actuated by the locating means so as to strike a selected object and to eject it from the conveying means. Alternatively the separating means may comprise a bank of deflecting fingers positioned across the width of the conveying means and below the end of the conveying means in a position such that objects passing over the end of the conveying means fall past the fingers, the fingers being operable under the control of the locating means to move between a by-pass position in which the objects fall past the fingers and a deflecting position in which a finger is raised and an object is deflected by the finger to a required destination different from objects falling past the fingers.

It will be appreciated that more than one selector member may be provided, and objects selected by different selector members may be directed in the same manner or differently by the separating means, depending on the requirement of the apparatus.

An embodiment of the invention will now be described by way of example with reference to the accompanying drawings, in which.

Figure 1:
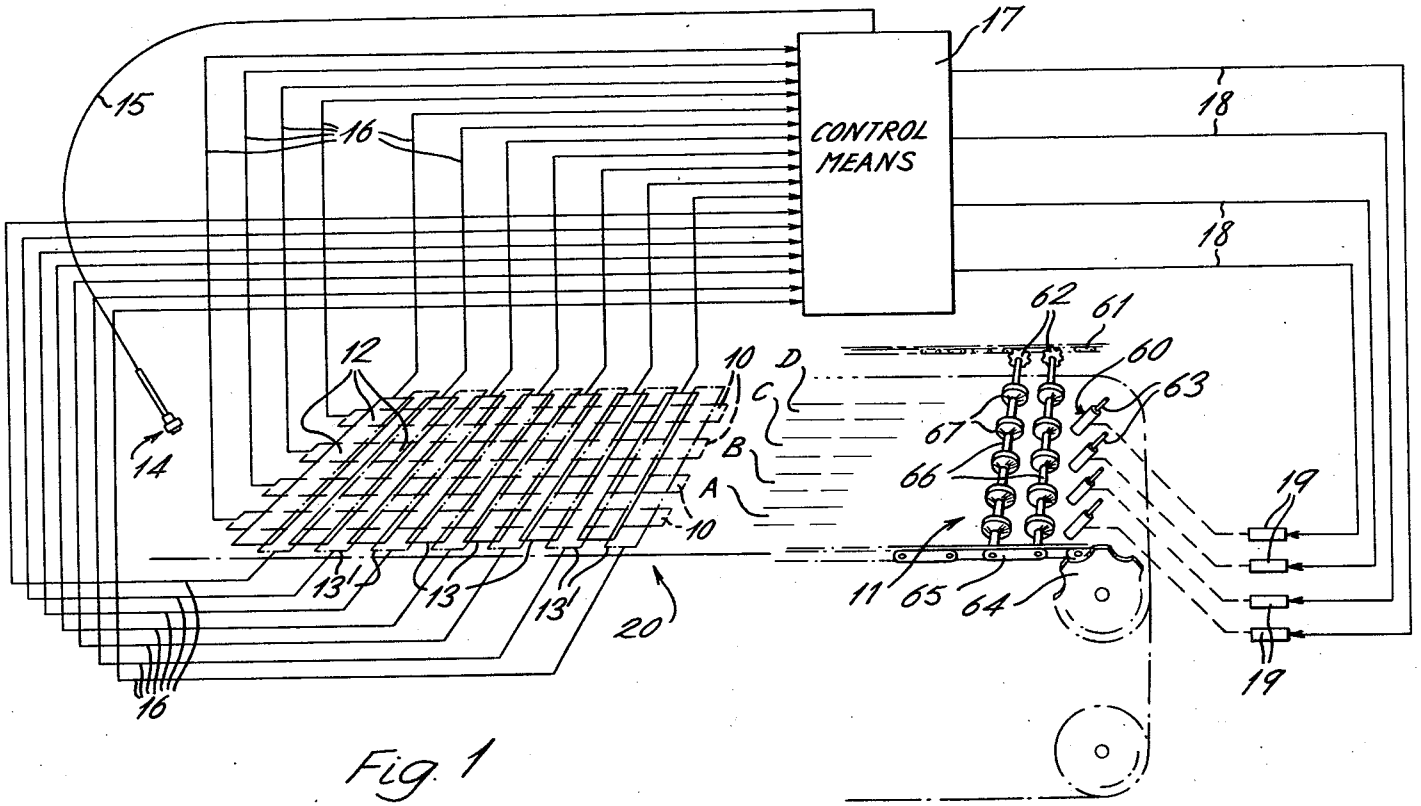
FIG. 1 shows diagrammatically the general layout of a sorting apparatus embodying the invention.
Figure 2:
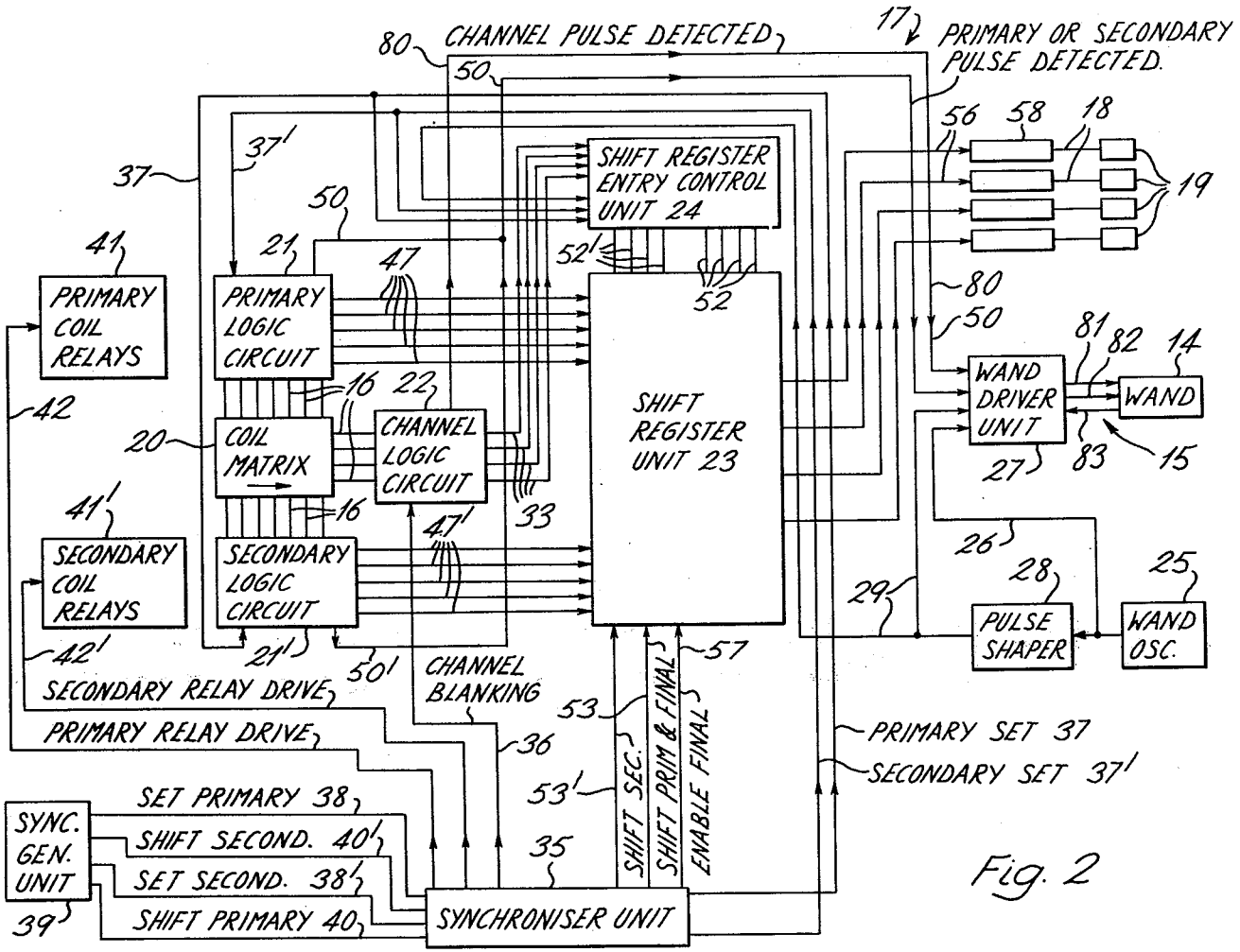
FIG. 2 is a block circuit diagram of a control means shown in FIG. 1, and includes diagrammatic representations of some mechanical components of FIG. 1.
Figure 3A:
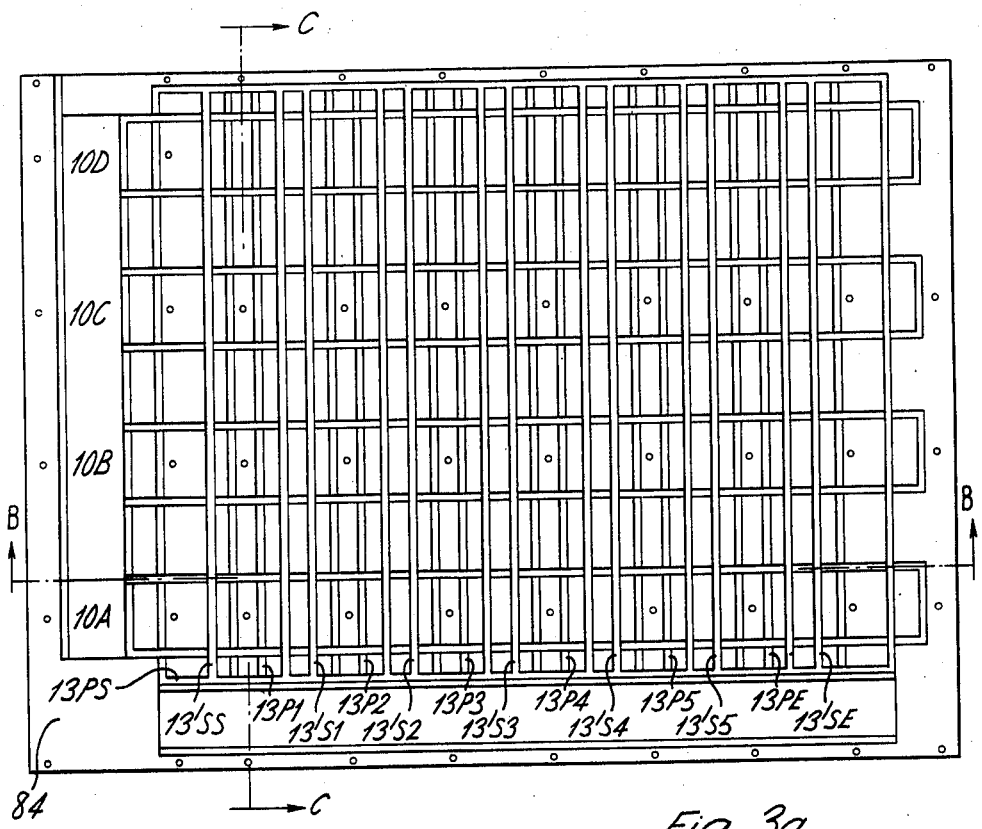
Figure 3B:
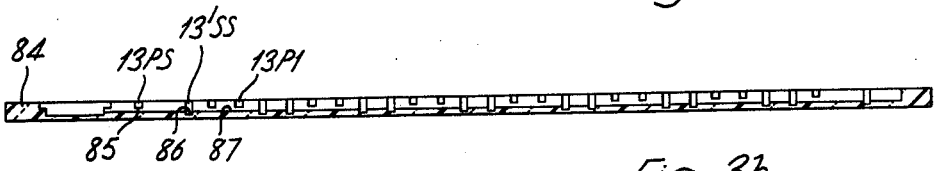
Figure 3C:
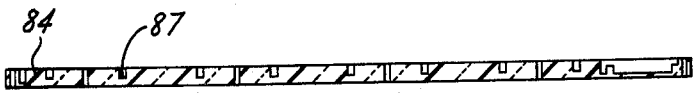
Figure 4:
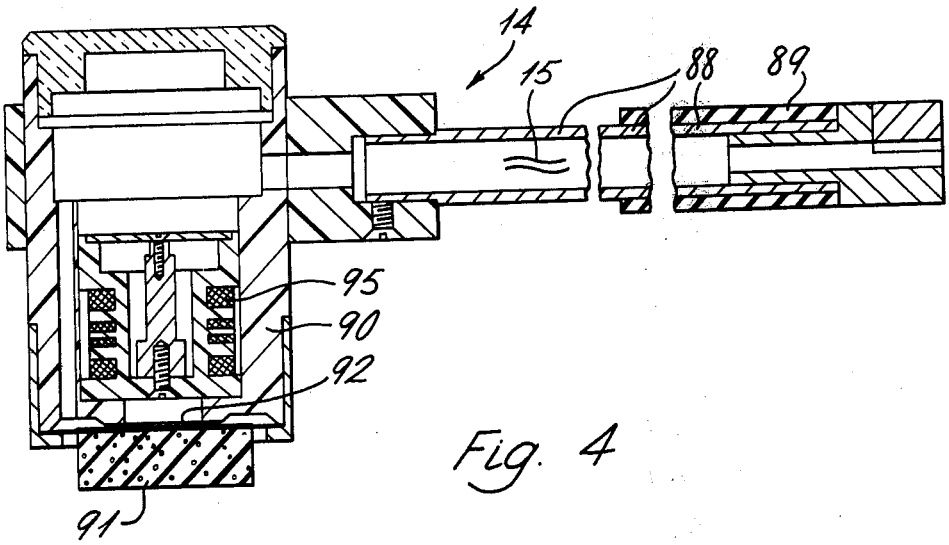
Figure 5:
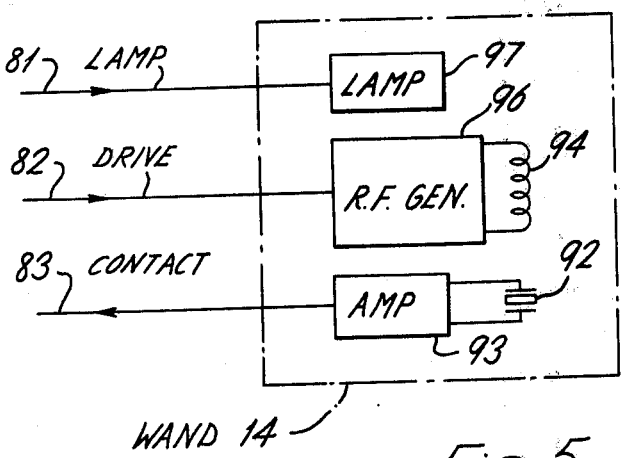
Figure 6:
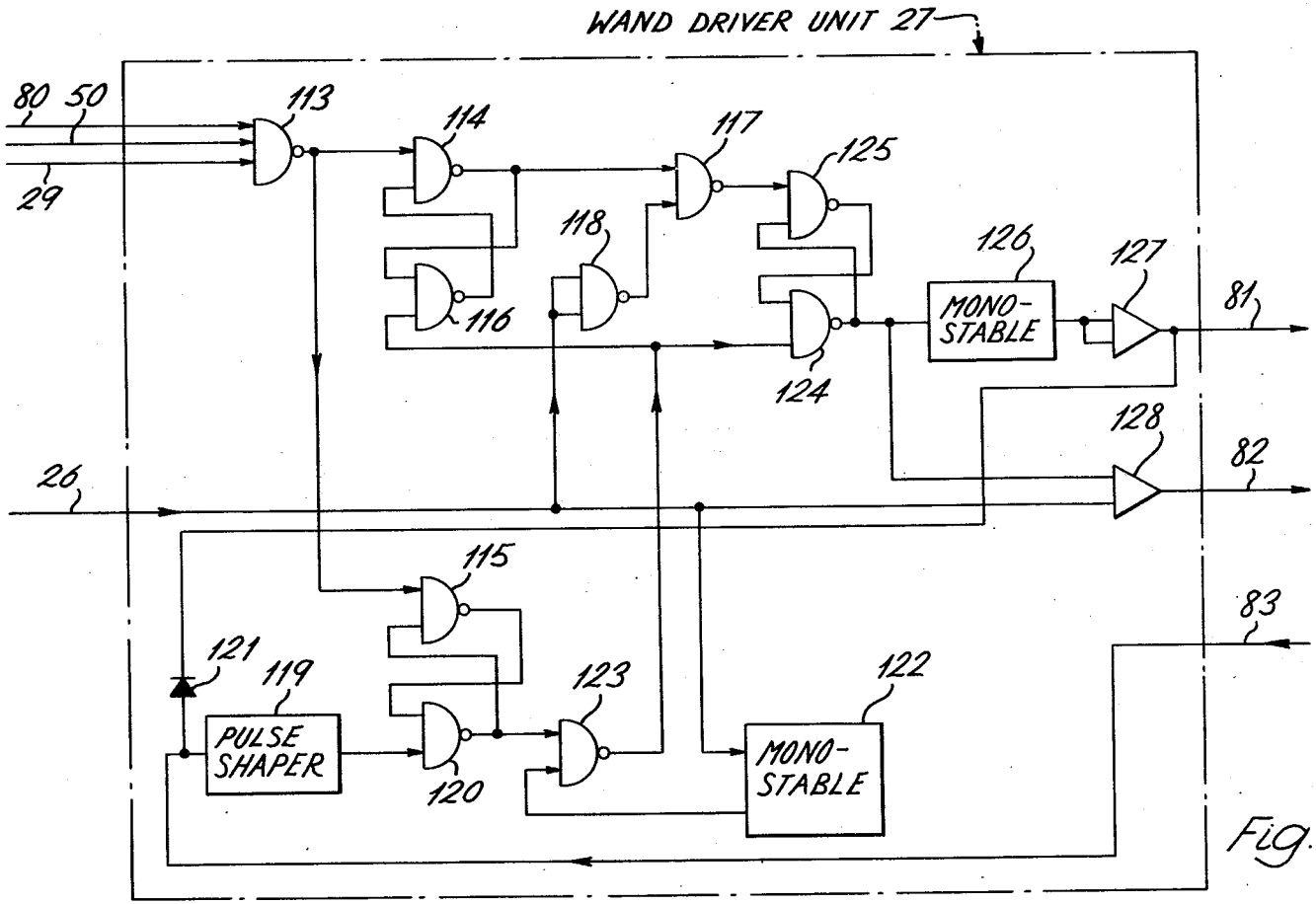
Figure 7:
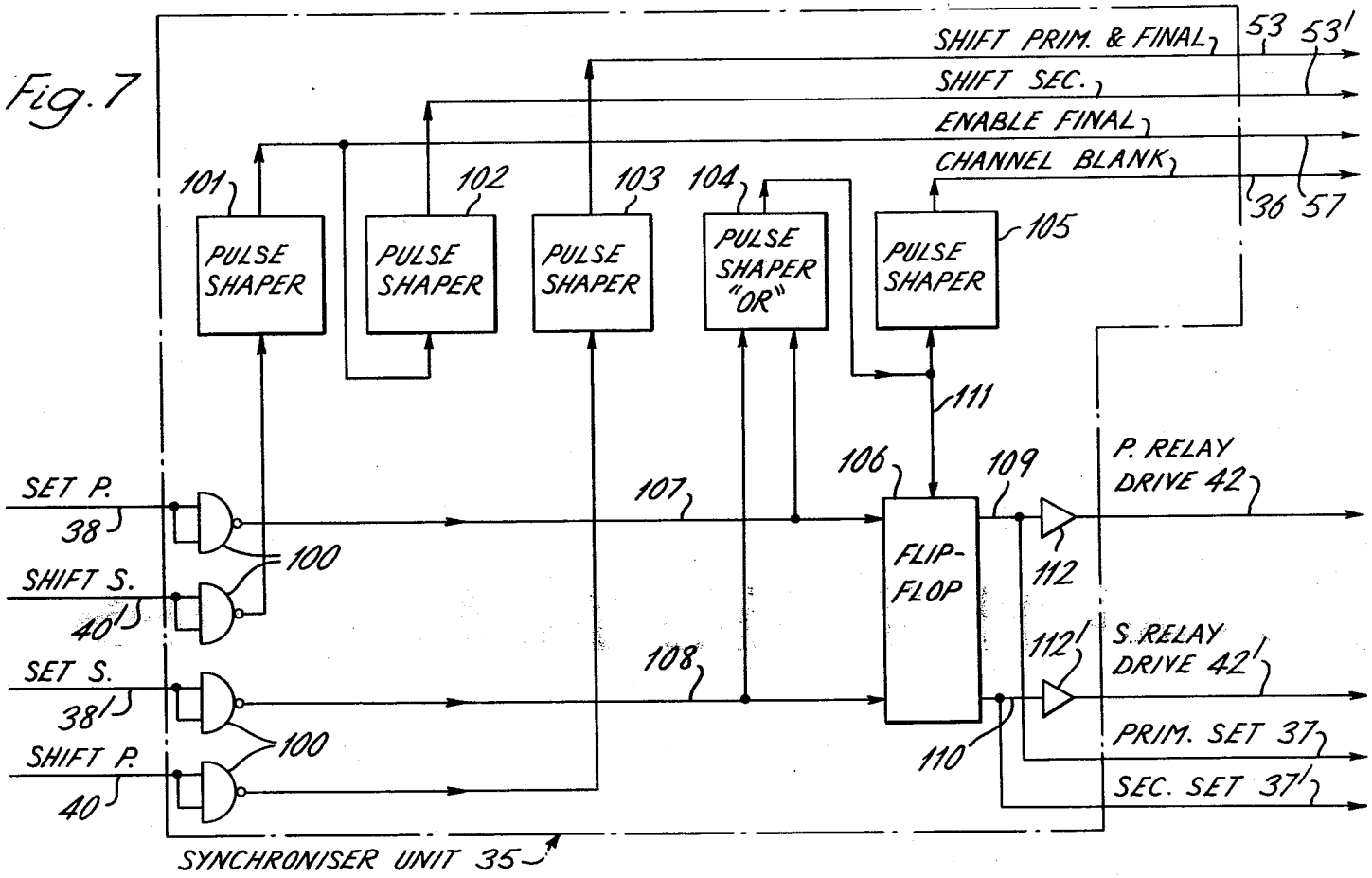
Figure 8:
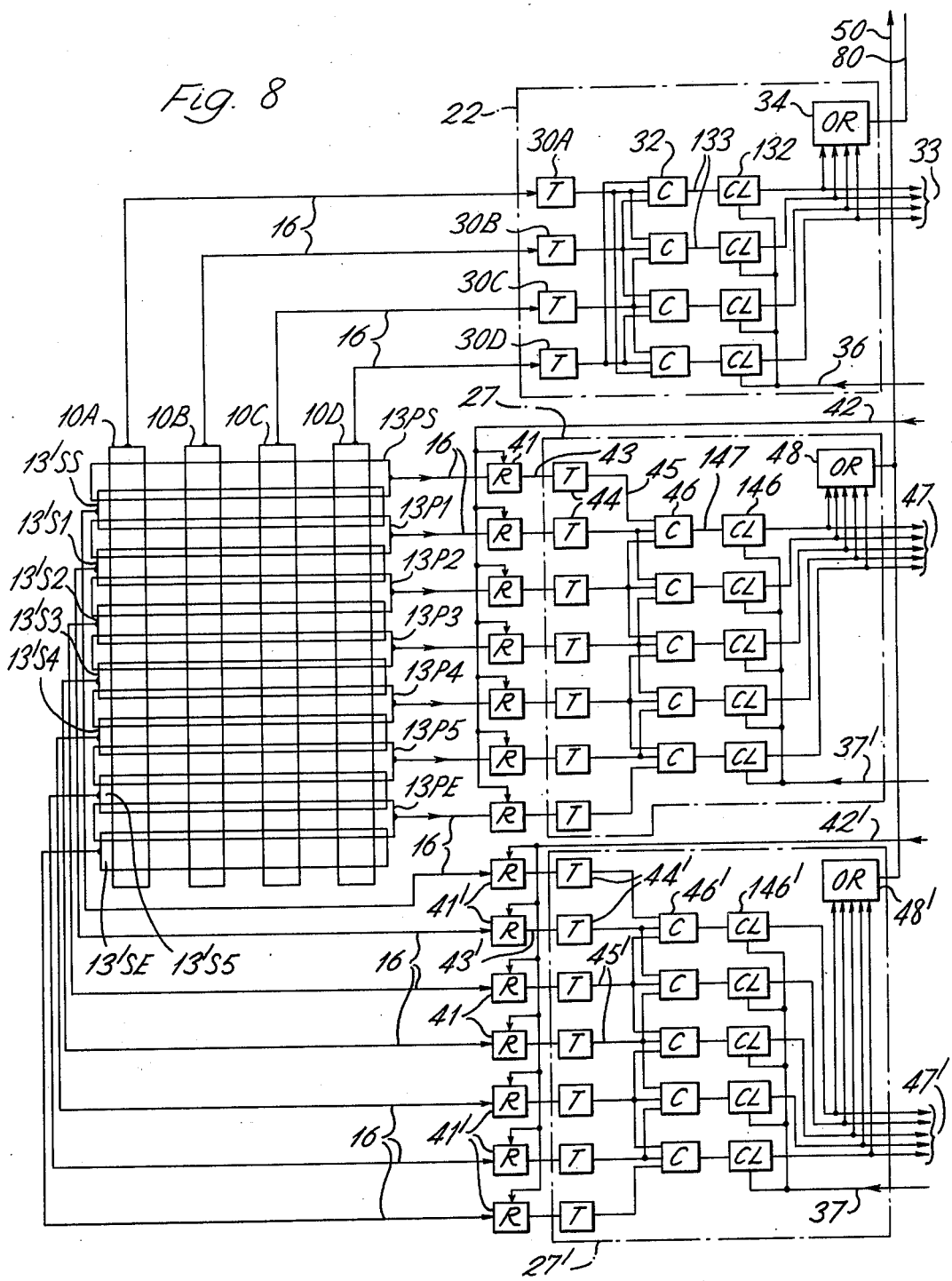
Figure 9:
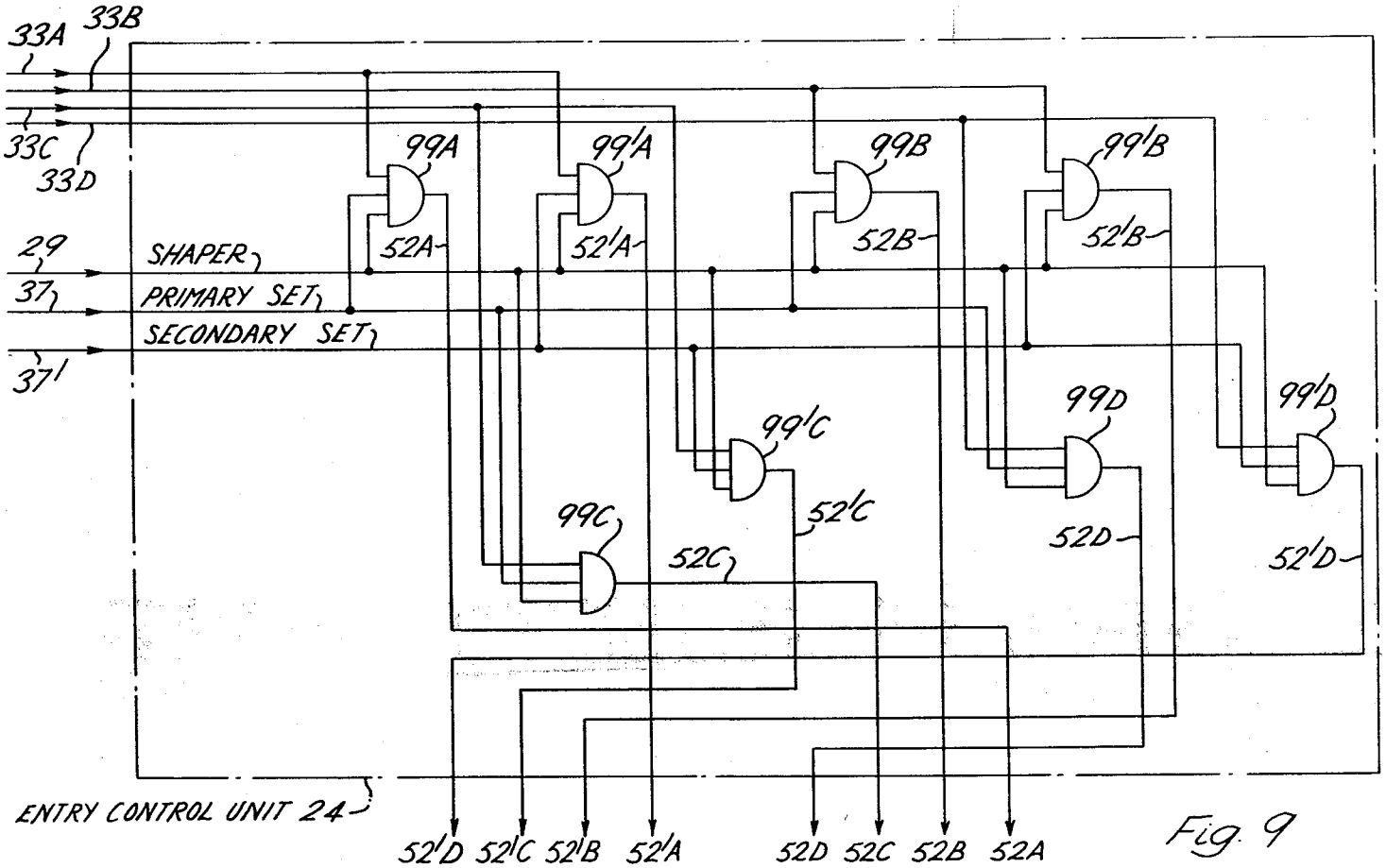
Figure 10:
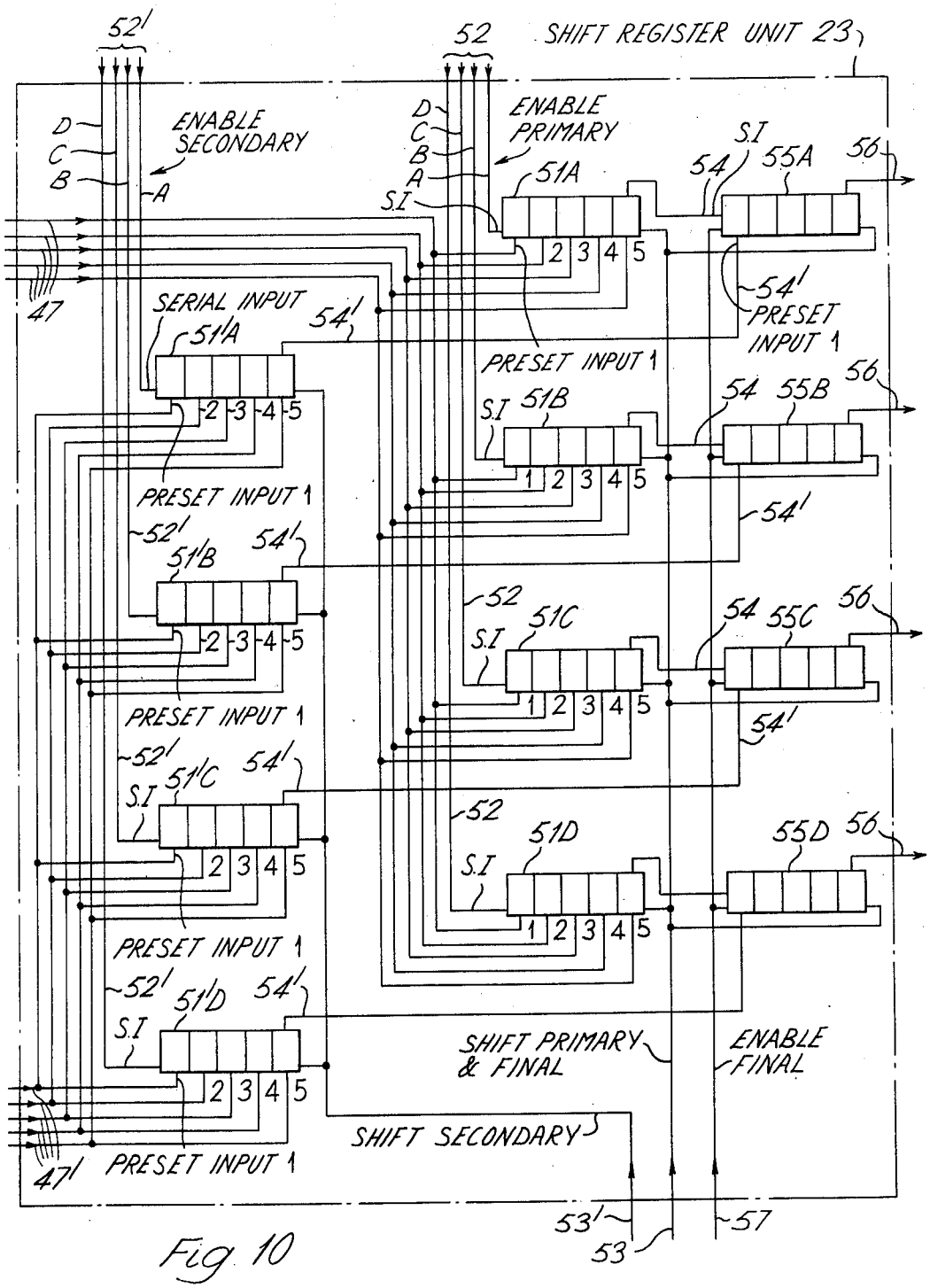
Figure 11:
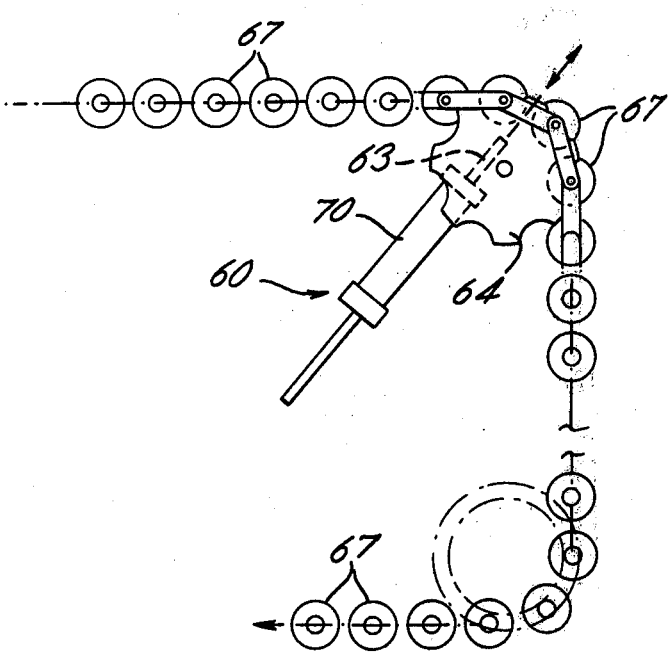
Figure 12:
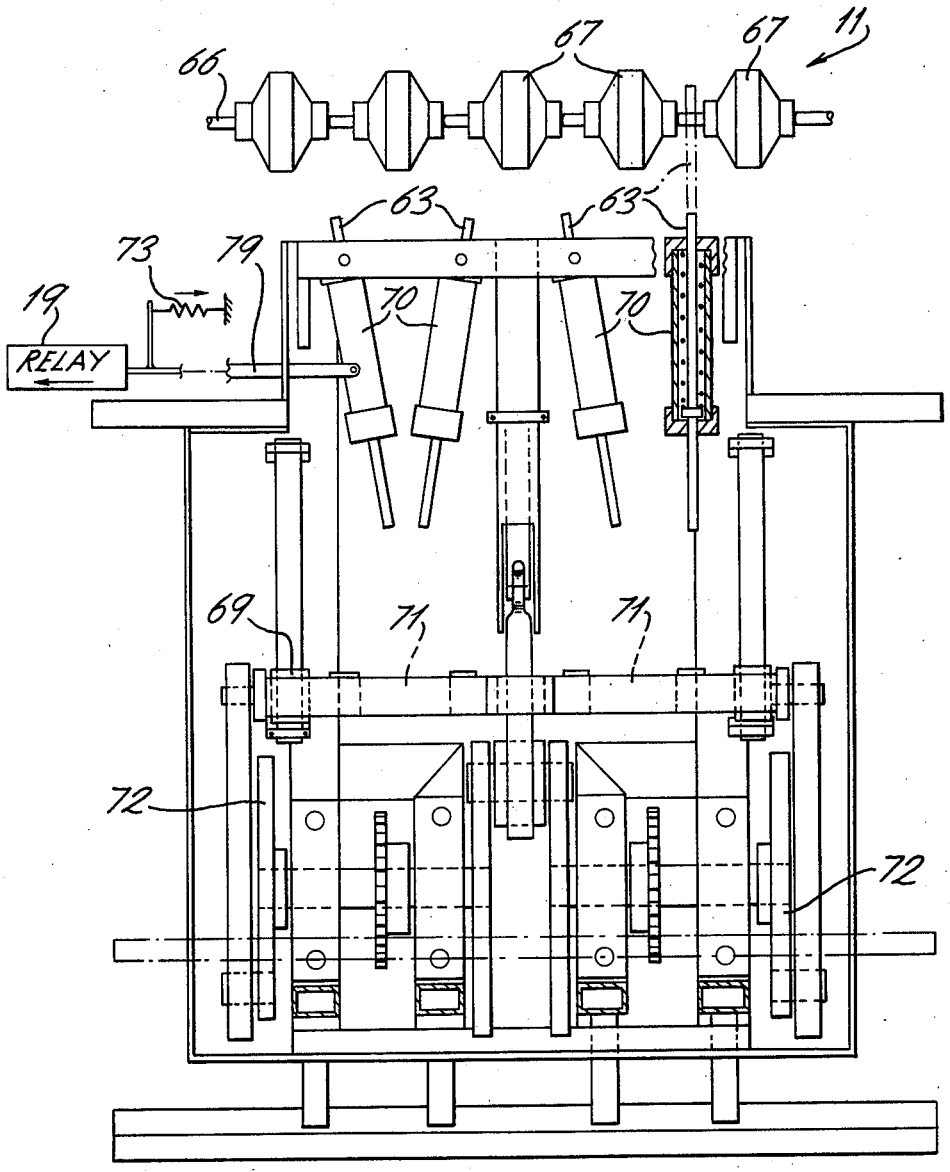
Figure 13:
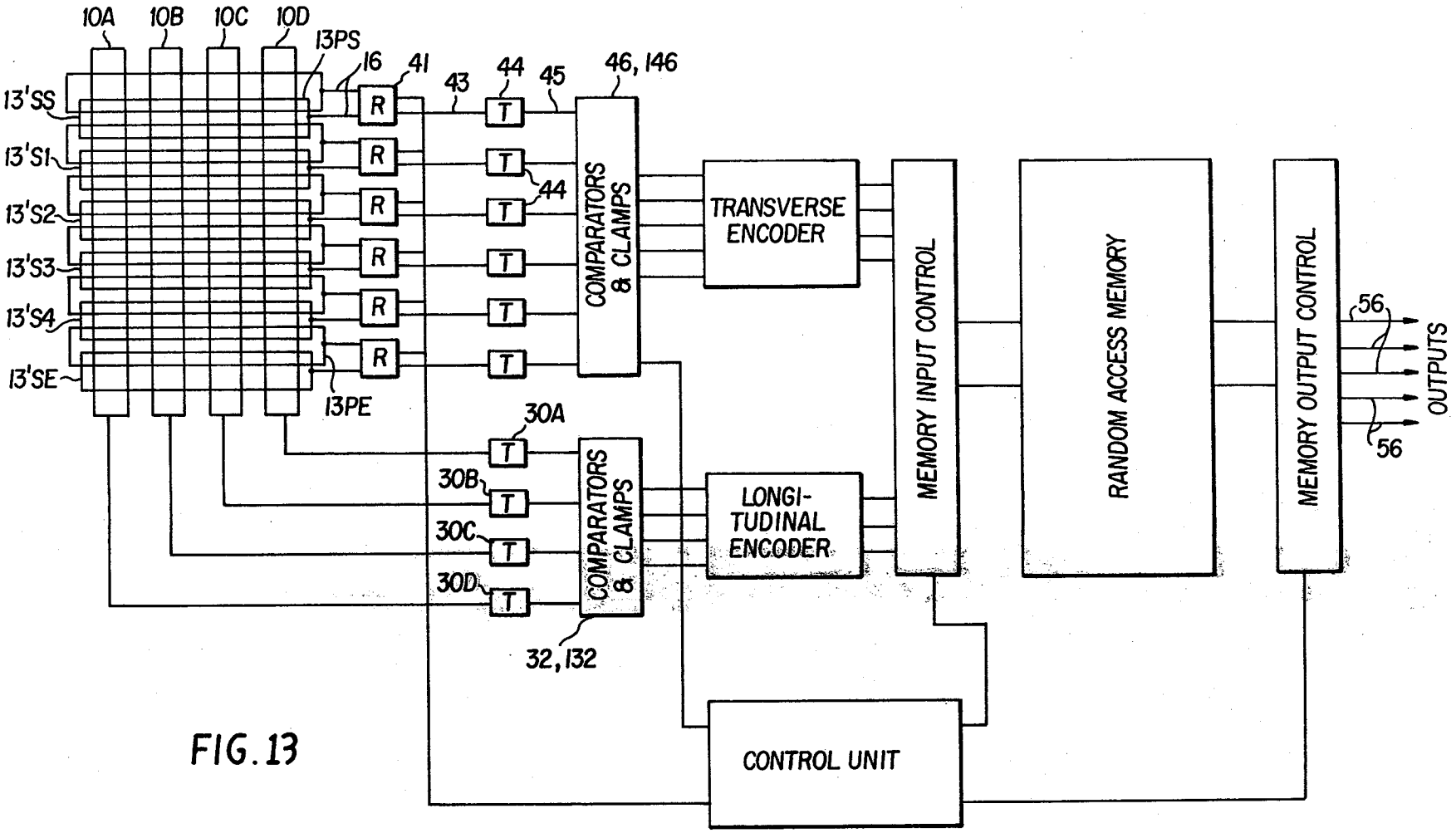

FIGS. 3(*a*), (*b*) and (*c*) are a plan view and two sections respectively of a coil array shown in FIG. 1;

FIG. 4 is a cross-section of a selector member constituted by a hand-held wand shown in FIG. 1;

FIG. 5 is a block circuit diagram of electrical circuits present in the wand shown in FIGS. 1 and 4;

FIG. 6 is a block circuit diagram of a wand driver unit shown in FIG. 2;

FIG. 7 is a block circuit diagram of a synchroniser unit shown in FIG. 2;

FIG. 8 is a block circuit diagram of a channel logic circuit, a primary logic circuit and a secondary logic circuit shown in FIG. 2, and also shows diagrammatically the layout of the coil array shown in FIGS. 1 and 3(*a*), (*b*) and 3(*c*);

FIG. 9 is a block circuit diagram of an entry control circuit shown in FIG. 2;

FIG. 10 is a block circuit diagram of a shift register unit shown in FIG. 2;

FIG. 11 is a diagrammatic side view of an ejector mechanism shown in FIG. 1; and FIG. 12 is a plan view partly in section of an array of ejector mechanisms shown in FIG. 1;

FIG. 13 is a block circuit diagram of a modification of the embodiment shown in FIGS. 8–10.

In FIG. 1 there is shown a diagrammatic representation of apparatus embodying the invention for sorting objects into two categories, for example, for separating potatoes into those which are satisfactory and those which are to be rejected for blemishes. The objects to be sorted are conveyed from left to right in FIG. 1 by a conveyor 11 which comprises a series of transfer shafts 66 carrying rubber covered rollers 67 spaced apart to define individual cells for carrying the objects to be selected or rejected. In effect the rollers 67 divide the face of conveyor 11 longitudinally into four channels which are labelled A, B, C and D. The rollers 67 also divide the channels A,B,C and D into succeeding cells which pass any fixed point at regular periods determined by the speed of movement of the conveyor 11. The shafts 66 are carried by side chains 65 which move the whole array of shafts and rollers in the form of a conveyor. The side chains 65 are driven by end sprockets 64.

The rollers 67 are caused to rotate during their longitudinal travel by a roller sprocket 62 on one end of each roller shaft 66. The sprocket 62 engages with an overhead chain 61 which may be static or driven so that varying amounts and directions of rotational movement of the rollers 67 may be imparted for a given length of travel. This rotation of the rollers 67 allows complete inspection of the objects on the conveyor 11 by the operator of the apparatus. Experiment in any particular case will show the optimum speed and direction of rotation of the objects to give full inspection by the operator of the material travelling before him.

Beneath the conveyor 11 is positioned a matrix of coils arranged in sets of orthogonal coils indicated generally as longitudinal or channel coils 10 and transverse coils 13 and 13'. The transverse coils 13 are designated primary coils and the transverse coils 13' are designated secondary coils. Each secondary coil 13' is staggered by half a coil pitch from its corresponding primary coil 13. The channel coils comprise four coils 10 parallel to the direction of movement of the conveyor 11 and positioned one under each of the four channels A, B, C and D formed by the rollers 67. The transverse coils comprise seven primary coils 13 and seven secondary coils 13'.

The arrangement of the coil matrix 20 is shown in more detail in FIGS. 3(*a*), 3(*b*), 3(*c*) and FIG. 8, where the four channel coils 10 are labelled individually as coils 10A, 10B, 10C and 10D. The seven primary coils 13 are labelled as primary start coil 13PS positioned at the beginning of the array of primary coils 13; five main primary coils labelled 13P1, 13P2, 13P3, 13P4 and 13P5; and a primary end coil labelled 13PE. In a corresponding manner the secondary coils 13' comprise a secondary start coil 13'SS; five main secondary coils labelled 13'S1, 13'S2, 13'S3, 13'S4 and 13'S5; and a secondary end coil labelled 13'SE.

In the example shown each of the coils 10, 13 and 13' comprises a flat horizontal coil of 35 turns of 26-gauge wire made of enamelled copper, each channel coil having a depth of 23½ inches and width of 2 inches, and each transverse coil having a width of 2 inches and length of 17 inches. The array of coils is set in the surface of a perspex plate 84, and the coils are set at three different levels in slots cut to form guides for the coils. As is shown in the section of FIG. 3(*b*), the primary coils 13 are set at a highest level 85, and the secondary coils 13' are set at a lowest level 86. The channel coils 10 are set at an intermediate level indicated at 87. In the transverse section of FIG. 3(*c*) only the intermediate level 87 of the channel coils 10 is shown in the plastic former 84. The purpose of the overlapping primary and secondary coils 13 and 13', and the purpose of the start and end coils, will be explained in more detail hereinafter.

There will now be given in very general terms a brief description of the overall operation of the apparatus shown in FIG. 1. The channel coils 10 and the transverse coils 13 and 13' provide an array of identifiable sites 12 defined by the intersections of pairs of the orthogonal coils. A selector member in the form of a light, hand-held wand 14 is powered by a flexible cable 15 from a control means 17. The term control means 17 is used to designate the various control circuits which will be described in more detail hereinafter and which are shown as a single block in FIG. 1. The functions of the control means 17 include energisation of the wand 14, and actuation or enabling of the coils 10, 13 and 13'. In operation the wand 14 is arranged to transmit a radio frequency electromagnetic signal which can be received by the coils 10, 13 and 13' when the wand 14 is in the vicinity of the matrix 20. The strength of the signals picked up by the different coils will be different according to the position of the wand 14 relative to the different coils, and at any moment the signals received by the different coils identify the site 12 which corresponds most closely to the position of the wand 14. Leads 16 feed signals from the coils 10, 13 and 13' to the control means 17 which decodes the signals and gives output signals on four leads 18 to four actuators 19. Each actuator 19 controls an individual ejector mechanism 60 driving a plunger 63. Collectively the ejector mechanism 60 constitute means for separating selected and unselected objects passing along the belt 11. In the embodiment described with reference to the drawings the objects selected by the wand 14 are those to be rejected by the separating means 60. The unselected objects are retained on the conveyor 11. The ejector mechanisms 60 are so arranged that when unactuated they allow unselected objects to pass over the end of the conveyor 11. When an object is required to be ejected, the corresponding ejector mechanism 60 is actuated, and the plunger 63 is driven through a space in the conveyor 11 and rejects the unwanted article.

Thus when an operator of the apparatus notes an object which he wishes to reject, for example a bad potato, he moves the wand 14 to the object to be rejected. The coils 10, 13 and 13' then pick up signals at different strengths depending on their positions relative to the member 14, and these signals identify the site corresponding most closely to the position of the selected object at that moment of time. The control means 17 decodes the various signals from the coils 10, 13 and 13', identifies the site corresponding to the selected object, introduces an appropriate delay to account for the movement of the conveyor 11, and then actuates the appropriate ejector mechanism 60. The chosen ejector mechanism 60 then ejects the unwanted object from the conveyor by means of the associated plunger 63.

There will now be explained with reference to FIG. 3(*a*) and FIG. 8 the purpose of providing the two sets of staggered transverse coils 13 and 13', and extra start and end coils 13PS, 13PE, 13'SS and 13'SE. The purpose of the pairing of the transverse coils 13 and 13' is to avoid incorrect detection signals being recorded when an object is midway between a pair of adjacent transverse coils of one set (e.g. between primary transverse coil 13P1 and primary transverse coil 13P2). If for example the transverse coils 13 were used alone without the transverse coils 13', as for example might be done in another embodiment of the invention, it would be necessary to restrict the entry of information into the control means 17 during the transition of objects past the dividing region between the transverse coils. If this were not done, and the wand 14 were not positioned strictly over the centre of a defined site 12 during selection, then the control means 17 would not be able to distinguish with reliability the longitudinal position of the object selected along the channels of the conveyor 11. This restriction of information entry, which can be arrayed in other embodiments, may give a dead time which amounts to some 30% of total detection ability of the apparatus. This dead time is avoided in the embodiment illustrated by providing a primary coil 13 and a secondary coil 13' in place of a single transverse coil. The set of primary coils 13 and the set of secondary coils 13' are alternatively brought into effect to feed detection information to the control means 17, each set of primary or secondary coils being in operation for 50% of the operating time by "enabling" signals to be described hereinafter. The enabling of the primary and secondary coils 13 and 13' is alternated periodically in synchronism with the movement of the conveyor 11 at a frequency corresponding to the period of each cell movement past a fixed point. The primary or secondary set of coils 13 or 13' which at any one time is not in use is arranged to be open circuited to prevent interaction with the enabled set of coils and this function is performed by an array of relays 41 and 41' shown in FIG. 8.

There are also shown in FIGS. 3(*a*) and 8 the four further transverse coils which are named as primary "start" coil 13PS, secondary "start" coil 13'SS, primary "end" coil 13PE and secondary "end" coil 13'SE. The purpose of these coils is to provide a comparison coil for the end transverse coils 13P1, 13S1, 13P5 and 13S5 respectively so as to provide a positive identification output signal for the first and fifth transverse coils of a similar nature to those obtained from the second to fourth transverse coils. This provides a definite limit to the active area of the matrix 20. If the end and start coils were not provided, the first and fifth primary and secondary coils would pick up and identify signals from the wand, even if the wand were in a rest position several feet away from the apparatus.

The embodiment shown in FIG. 1 will now be described in more detail with reference to FIG. 2. FIG. 2 is a block circuit diagram showing in more detail the component elements of the control means 17. In FIG. 2 the only mechanical elements represented are the coil matrix 20, the actuators 19, the wand 14 and the cable 15. All the remaining items shown in FIG. 3 constitute components of the control means 17 of FIG. 1.

In FIG. 2 the matrix of coils is indicated diagrammatically by a single box 20 and the arrow in the box indicates diagrammatically the movement of the conveyor 11 of FIG. 1. From the end of the matrix 20 leads 16 are shown carrying information from the channel coils 10 of FIG. 1 to a channel logic circuit 22. The leads 16 on the upper side of the matrix 20 carry information to a primary logic circuit 21 and the leads 16 on the lower side of the matrix 20 carry the information to a secondary logic circuit 21'.

The primary logic circuit 21 has five output leads 47 and is arranged to provide (when the wand 14 is actuated) on one of these leads 47 a signal indicating which of the five primary coils 13P1, 13P2, 13P3, 13P4 and 13P5, has received the strongest signal from the wand 14. Similarly the secondary logic circuit 21' has five output leads 47' which provide a one-out-of-five signal indicating which of the five secondary coils 13'S1, 13'S2, 13'S3, 13'S4, 13'S5, has received the strongest signal from the wand 14. The channel logic circuit 22 has four output leads 33, providing a one-out-of-four signal indicating which of the four channel coils 10A, 10B, 10C or 10D has received the strongest signal from the wand 14. The operation of the three circuits 21, 21' and 23 will be described in greater detail hereinafter with reference to FIGS. 8 and 9.

The outputs from the primary logic and secondary logic circuits 21 and 21' are fed along the leads 47 and 47' to a shift register unit 23 which decodes the information provided by the transverse coils 13 and 13' to determine the position along the conveyor 11 which has been selected by the wand 14. The stepping of shift registers in the shift register unit (which will be described hereinafter with reference to FIG. 10) is also used to introduce the required delay which the objects travel between the matrix 20 and the ejector mechanisms 60 in FIG. 1.

The channel logic circuit 22 feeds information along its output leads 33 to a shift register entry control unit 24 which decodes the information as to which of the four channels A, B, C or D in FIG. 1 has been selected by the wand 14. This decoded information is fed into the shift register unit 23 along four leads 52 and four leads 52' which respectively control four primary shift registers and four secondary shift registers positioned in the shift register 23 and shown in more detail in FIG. 10. The entry control unit 24 is shown in more detail in FIG. 9.

The shift register unit 23 has four output leads 56 which are fed to four thyristor drive amplifiers 58 which provide four output control signals along the output leads 18 leading to the four actuator units 19 which have already been shown in FIG. 1.

As has already been mentioned, with reference to FIG. 8, the primary and secondary coils 13 and 13' are blanked alternately by two sets of relays 41 and 41' and these are shown in FIG. 2 as being controlled by signals along leads 42 and 42' respectively. These leads 42 and 42' constitute outputs of a main synchroniser unit 35 which provides synchronising signals for a number of units in the control means 17. Considering in turn the outputs of the synchroniser unit 35, the two output leads 42 and 42' already mentioned control the blanking of the primary and secondary coils 13 and 13' by the coil relays 41 and 41'. A further output lead 36 feeds a channel blanking signal to the channel logic circuit 22. Three further outputs 53', 53 and 57 from the synchroniser unit 35 lead to the shift register unit 23 and carry signals referred to as shift-secondary signal, shift-primary-and-final signal, and enable-final signal, the purposes of which will be described hereinafter. Two further outputs 37 and 37' lead to the shift register entry control unit and provide control signals referred to as primary-set and secondary-set signals respectively which control which of the primary and secondary circuits in the entry control unit 24 are energised at any one time in correspondence with the alternation of energisation of the primary and secondary coils 13 and 13'. The output leads 37 and 37' from the synchroniser unit 35 also lead to the primary logic circuit 21 and the secondary logic circuit 21' respectively to control blanking of the primary and secondary logic circuits in correspondence with the alternating energisation of the coils 13 and 13'.

The drive for the synchroniser unit 35 is supplied by a synchroniser generating unit 39 along four leads 38, 40', 38', 40. The synchroniser generator unit 39 consists of a rotary Hall effect switch generator driven mechanically in time with the movement of the conveyor 11 so as to have a period of repetition equal to the period set by movement of a single cell of the conveyor 11 past a fixed point. The synchroniser generator unit 39 is arranged to provide four pulses along the leads 38, 40', 38' and 40 separated from each other by 90° of phase. The timing signals along the leads 37 and 37' and along leads 42 and 42' are signals indicating an "on" or "off" state and each continues in a set state for half of the period of the synchroniser generator unit 39. The signals along the leads 37 and 37', and 42 and 42' are signals of the same timing but are set at different power rates since the signals along the leads 37 and 37' are required to control logic circuits whereas signals along the leads 42 and 42' are required to control electro-magnetic relays.

The wand 14 is arranged to provide bursts of radio frequency signal at frequency which may conveniently be in a range 100 KHz to 10 MegaHz, for example 246 KHz, pulsed at a pulse frequency which may conveniently be in a range 100 Hz to 1 KHz, for example 500 Hz. The control frequency of the pulses is produced by a wand oscillator 25 which feeds its output along a line 26 to a wand driver unit 27. The wand oscillator lead 26 is also connected to an input of a pulse shaper 28 which produces a sharp edged pulse which is fed along a lead 29 to the wand driver unit 27. The purpose of feeding to the wand driver unit 27 both the shaped pulse from the pulse shaper 28 and the original pulse from wand oscillator 25 is to select only the centre portion of the detected wand pulse for reliable evidence of such selection. The output lead 29 from the pulse shaper 28 is also connected to the shift register entry control unit 24.

The wand driver unit 27 receives two further input signals along leads 80 and 50. The lead 80 is coupled to an output from the channel logic circuit 22, and the lead 50 is coupled to outputs of both the primary logic circuit 21 and the secondary logic circuit 21'. The purpose of the signals along the leads 80 and 50 is to determine when a signal from the wand 14 has been detected by a channel coil 10 and by either a tranvserse coil 13 or a transverse coil 13'. When this condition is effected the wand driver unit discontinues energisation of the wand 14 as will be described hereinafter.

The wand driver unit 27 is connected to the wand 14 by the flexible cable 15 and which is shown as containing three leads 81, 82 and 83. The lead 82 is designated as the drive lead and carries the energising pulse for producing the radio frequency signal from the wand 14. The lead 83 is designated a contact lead and provides a feedback signal to the wand driver unit 27 indicating that the wand has contacted a selected object. The lead 81 is designated the lamp lead and carries a signal from the wand driver unit 27 to the wand 14 which lights a lamp in the wand when a signal has been successfully detected by the coil matrix 20. These functions will be described in more detail hereinafter with reference to FIGS. 5 and 6.

Referring now to FIGS. 4 and 5, the wand 14 will now be described in greater detail. The wand 14 comprises a main metal handle 88 having a rubber covered holding portion 89 and having a hollow centre through which passes the cable indicated generally at 15, and comprising the three separate leads 81, 82 and 83 shown in FIG. 2. Handle 88 is connected to a main housing 90 at the end of the handle and set in the lower end of the housing 19 is a foam rubber pad 91. At the back of the rubber pad 91 is a piezoelectric transducer 92 which is shown physically in FIG. 4 and is represented in the circuit of FIG. 5 as a diagrammatic generator. The piezoelectric generator 92 is arranged so that upon a light pressure on the pad 91, a low voltage signal in the range of approximately 100 to 500 millivolts is produced and is fed to an amplifier 93. The output of the amplifying circuit 93 is fed back to the wand driver unit 27 along the lead 83 as shown in FIG. 2.

The r.f. signal produced by the wand 14 to be picked up by the matrix 20 is produced by a coil 94 shown in FIG. 4 as being wound on a former 95 and shown diagrammatically in FIG. 5. The coil 94 is connected to a tuned circuit 96 which is driven by pulses arriving along the lead 82 from the wand driver unit 27 in FIG. 2.

There is also provided in the housing 90 of the wand 14 an indicator lamp 97 driven by a pulse from the wand driver unit 27 along the lead 81. (There are also provided in the cable 15 two further leads at +6 volts and 0 volts respectively which supply power to the lamp 97, the tuned circuit 96, and the piezoelectric crystal 93, but these are omitted from the drawings for simplicity.)

By way of example the r.f. generator circuit 96 and 94 may comprise a two transistor push-pull feedback oscillator. The coil 94 may be tuned by a parallel capacitor to around 250 KHz.

Thus to summarise, the functions of the elements of the wand 14 are firstly, the piezoelectric generator 92 detects that the wand has touched an object to be rejected and the appropriate signal is fed along the line 83 to the wand driver unit 27. In response to this a series of pulses from the wand driver unit 27, originating in the wand oscillator 25, are fed along the lead 82 of the r.f. generator circuit 96, 94 producing pulses of radio frequency signal. When this signal has been successfully picked up by both a longitudinal channel coil 10 and a transverse coil 13 or 13', and the appropriate information has been recorded in the control means 17, the control means 17 produces (as will be described hereinafter) a signal along the lead 81 leading back to the wand 14 which produces a flash of light on the lamp 97 to indicate to the operator that the selection has been correctly noted in the control means 17. The signal which operates the lamp 97 also stops the feeding of further pulses along the lead 82 to the r.f. generator circuit 96, 94 so that the generation of r.f. signal at the wand 14 ceases.

There will next be described the circuit of FIG. 6 which shows in block circuit diagram form the wand driver unit 27 shown in FIG. 2. The inputs to the wand driver unit 27 comprise the drive pulses on the lead 26 from the wand oscillator 25; the shaped pulses from the pulse shaper 28 along the lead 29 (corresponding to the wand pulses on the lead 26 but in the form of a shaped narrow pulse formed by sampling the centre of the wand pulse, and giving a pulse delayed relative to the beginning of the wand pulse); the signal on the line 80 from the channel logic circuit 22 indicating that the channel coils have successfully detected the wand signal; and a corresponding signal on the lead 50 from the primary or secondary logic circuits 21 and 21'. There is also provided an input on the lead 83 from the wand 14 which indicates when the piezoelectric generator 92 has been energised.

The three inputs on the leads 29, 80 and 50 are all fed to a three input NAND gate 113 the output of which is fed to a NAND gate 114, and to a NAND gate 115. The NAND gate 114 is coupled to a further NAND gate 116 as shown to form a bistable circuit the output of which is fed to a further NAND gate 117. The signal from the lead 26 is also fed to both inputs of a NAND gate 118 acting as an inverter the output of which is fed to the second input of the NAND gate 117.

The input on the lead 83 is fed through a monostable pulse shaper 119 to a NAND gate 120 which is coupled as shown with the NAND gate 115 to form a bistable circuit. The input to the pulse shaper 119 is also coupled by way of a diode 121 to the output of the amplifier 127 in order to prevent generation of spurious output pulses from the amplifier 93 in the wand 14 in response to the r.f. signal produced by the r.f. generator in the wand 14. This is achieved by clamping the output of the amplifier 93 to ground during the lamp pulse produced by the monostable 126 and its amplifier 127.

The signal on the lead 26 from the wand oscillator 25 is also fed to a monostable pulse shaper 122 the output of which is fed to a NAND gate 123 which has its second input fed from the output of the bistable circuit constituted by the NAND gates 115 and 120. The output of the NAND gate 123 is fed to the second input of the bistable circuit formed by the NAND gates 114 and 116. The output of the NAND gate 123 is also fed to a NAND gate 124 which is coupled with a NAND gate 125 to form a bistable circuit, the NAND gate 125 having its input fed from the output of the NAND gate 117. The output of the bistable circuit comprising the NAND gates 124 and 125 is fed to a monostable pulse shaping circuit 126 the output of which is fed to an amplifying circuit 127. The output of the bistable circuit comprising the NAND gates 124 and 125 is also fed directly to an amplifying circuit 128 having two inputs performing an AND function. The second input for the amplifier 128 is fed from the lead 26 from the wand oscillator 25. The outputs of the amplifiers 127 and 128 are fed respectively to the output leads 81 and 82 in the flexible cable 15 leading to the wand 14.

The manner of operation of the circuit of FIG. 6 will now be described. An input pulse on the lead 83 indicating that an object has been selected sets the bistable circuit 115, 120, which in turn allows the leading edge of the next wand pulse on lead 26 shaped by monostable 122 to set the bistable circuit 124, 125 and opens the AND gate amplifier 128 so that pulses from the wand oscillator along the lead 26 pass to the output lead 82 and energise the r.f. generator 96, 94, in the wand 14. When a signal has successfully been detected by channel and primary or secondary coils, the NAND gate 113 is opened by signals along the leads 50, 80 and 29, and resets the bistable circuit 115, 120. The output of the NAND gate 113 also resets the bistable circuit 114, 116 which in turn allows the NAND gate 118 to reset the bistable circuit 124, 125 at the end of the wand drive pulse. The output of the bistable circuit 124, 125 than closes the AND gate amplifier 128 terminating the energisation of the r.f. generator 96, 94 in the wand 14, and at the same time sends a signal along the lead 81 to operate the lamp in the wand 14.

In FIG. 7 there is shown a block circuit diagram of the synchroniser unit 35 shown in FIG. 2. The inputs to the synchroniser unit 35 consist of four signals of indeterminate length separated by 90° of phase and generated by the Hall effect generator 39 rotating in synchronism with the conveyor 11. The inputs are on leads 38, 40', 38' and 40. Signals on each of the input leads are fed to four Schmidt trigger circuits 100 for removing interference from the signals on the leads 38, 38', 40' and 40.

The shift-secondary signal from the Schmidt trigger circuit 100 which is fed by the lead 40' is fed to a pulse shaper 101 which forms a narrow pulse constituting the enable-final signal on the output lead 57. The signal from the pulse shaper 101 is also fed to the input of a second pulse shaper 102 which produces a similar narrow pulse constituting the shift-secondary signal on the output lead 53'. The output of the pulse shaper 102 is delayed relative to the output signal from the pulse shaper 101 by the width of the output pulse since each of the pulse shapers 101 and 102 detects the leading edge of an input pulse to it.

The output of the Schmidt trigger circuit 100 which is fed by the lead 40 is fed to a third pulse shaper 103 which produces a narrow output pulse constituting the shift-primary-and-final signal on the output lead 53.

A fourth pulse shaper 104 receives inputs from the Schmidt trigger circuits 100 which are fed by the leads 38 and 38' and provides an OR function to produce a narrow output pulse upon detection of the leading edge of an input pulse on either of its two inputs. The output of the pulse shaper 104 is fed to a fifth pulse shaper 105 which produces a narrow output pulse constituting the channel blanking signal on the output lead 36.

The output of the pulse shaper 104 is also fed to a trigger input terminal of a triggered flip-flop circuit 106. The flip-flop circuit 106 has two main inputs from the Schmidt trigger circuit 100 which is fed by the input leads 38 and 38' and has two output terminals providing signals on leads 109 and 110. The flip-flop 106 is arranged to operate in such a manner that one of the signals on leads 109 or 110 has a logic 1 while the other has a logic 0, and the two outputs are alternated in accordance with the inputs along the leads 107 and 108. In addition to the output on the leads 109 and 110 being determined by the inputs on leads 107 and 108, the instant at which the changeover is made is determined by the pulse arriving on the trigger input terminal 111 from the pulse shaper 104. The output signal on the lead 109 is fed by way of an amplifier 112 to provide the primary-relay-drive signal on the output lead 42 and the output signal on the lead 110 is fed by way of a corresponding amplifier 112' to provide the secondary-relay-drive signal on lead 42'. The output signals on the leads 109 and 110 are also fed directly to provide the primary-set and secondary-set signals on the output leads 37 and 37'.

There will now be described the construction and operation of the main units of the control means 17 shown in FIG. 2, namely those elements concerned with decoding, recording and acting upon signals detected by the matrix of coils 20. The main elements concerned with this decoding are the primary and secondary logic circuits 21 and 21', the shift register entry control unit 24, and the shift register unit 23. The functions of these elements will be described mainly with reference to FIGS. 8 and 9 and 10.

Referring to FIG. 8, each of the longitudinal channel coils 10 is connected by an output lead 16 to a tuner 30 individual thereto which has the purpose of tuning the corresponding coil to receive the radio frequency signal from the wand 14. Each coil is tuned by a parallel capacitor and half-way rectification is provided to produce a unidirectional voltage signal derived from each coil whenever it is excited by the field from the wand 14. The outputs of the tuners 30 are four signals of varying analogue magnitudes depending upon which of the four channel coils 10A, 10B, 10C or 10D is closest to the wand 14. The outputs of the tuners 30 are fed along leads 31 to four double comparators 32 arranged to give at four output leads 133 a one-out-of-four response which indicates to which of the coils 10A, 10B, 10C and 10D the wand 14 is closest. The comparators 32 are referenced individually as 32A, 32B and 32C and 32D. By way of example the operation of 32A is such that if the three inputs to the double comparator are 32A connected as shown to receive signals from tuners 30D, 30A and 30B, the comparator 32A produces an output signal if the signal at coil 10A is greater than the signal at coil 10B, and if the signal at coil 10A is greater than the signal at coil 10D. The remaining comparators 32 are correspondingly connected as shown. Thus whereas the outputs of the leads 31 to the tuners 30 are analogue signals of varying magnitude, the outputs on the leads 133 from the comparators 32 are digital signals of which one at any one time gives a positive identification of the transverse position of the wand 14.

The outputs on the leads 133 are fed to four clamp circuits 132 which are controlled by the channel blanking signal on the lead 36 from the synchroniser unit 35 in FIG. 2. The clamp circuits 132 are arranged in such a manner as to clamp at zero the outputs of the comparators 32 for a brief interval at each changeover time of the enabling of the primary and secondary coils 13 and 13'. The purpose of this clamping is to avoid spurious signals leaving the comparators 32 during these changeover intervals.

The outputs of the clamp circuits 132 are fed along four leads 33, and are taken in a side circuit to a four entry OR gate 34 which is coupled through a lead 80 to the wand driver unit 27 (FIG. 2). The purpose of the signal on this lead 80 is to detect when a signal has been successfully detected by a channel coil 10. The main output route of the signals on the leads 33 is to the shift register entry control unit 24 shown in detail in FIG. 9. The purpose of this shift register entry control unit 24 is to "enable" a number of shift registers (in the shift register unit 23) the stages of which are set by information signals from the transverse coils 13 and 13'. The main timing of the shift register entry control unit 24 is provided by the two timing signals labelled primary set and secondary set fed along lines 37 and 37' from the synchroniser unit 35 in FIG. 2. These signals provide on or off signals which alternate in phase with the energisation and blanking of the primary and secondary coils by the primary and secondary coil relays 41 and 41'. However, the actual action of the shift register entry control unit 24 only takes place during selected periods of the primary set and secondary set signals and these selected sample periods are provided by a shaper pulse fed along the lead 29 from the pulse shaper 28 shown in FIG. 2. The purpose of the shaper pulse 29 is to operate the shift register entry control unit 24 at the centre of the burst of r.f. signal generated by the wand 14.

Referring still to FIG. 9, the unit 24 comprises eight three-input AND gates labelled generally as AND gates 99 and 99', the AND gates 99 being associated with the period defined by the primary-set signal on lead 37 and the AND gates 99' being associated with the period set by the secondary-set signal on the lead 37'. The AND gates 99 and 99' are labelled individually as gates 99A, 99'A, 99B, 99'B and so on and are associated with the four channels A, B, C and D of the channel coils 10. The inputs will be described in detail with reference to the first AND gate 99A, the remaining gates being connected in a corresponding manner as shown. The AND gate 99A has one input connected to the lead 33A, a second input connected to the primary-set signal lead 37 and a third input connected to the pulse shaper lead 29. An output from the AND gate 99A is fed along a lead 52A to the shift register unit 23. Corresponding outputs from the remaining AND gates 99 and 99' are labelled 52B, 52C, 52D and 52'A, 52'B and 52'C and 52'D and correspondingly fed to the shift register unit 23 to provide enabling signals to control the shift registers of the unit 23.

Turning now to the decoding circuits of the transverse coils 13 and 13' the detection system will be described firstly with regard to the primary transverse coils 13. The secondary transverse coils 13' are a duplication of the primary coils and elements associated with the secondary coils will be indicated by corresponding dashed reference numerals.

There will now be described the primary and secondary logic circuits 21 and 21' of FIG. 2, shown in particular in FIG. 8. The outputs of the primary coils 13 including the primary-start and primary-end coils 13PS and 13PE are fed along the leads 16 to an array of dual-in-line, normally open, coil switching relays 41. The purpose of the primary relays 41 is to open-circuit the primary coils 13 during that half of the operating time when the secondary transverse coils 13' are in use and the primary transverse coils 13 are not in use. The relays 41 are switched open or closed by the primary-set signal along the lead 42 from the synchroniser unit 35 in FIG. 2. The corresponding series of relays 41' are connected by corresponding leads 16 to the secondary transverse coils 13' and are controlled by the secondary set signals on the lead 42' from the synchroniser unit 35 in FIG. 2. The relays 41 and 41' are opened and closed alternately and periodically in synchronism with the movement of the conveyor 11 (FIG. 1) and with the enabling of the shift registers in the shift register unit 23 by the enabling signals 52 and 52' from the control units 24. The outputs of the relays 41 are fed along leads 43 to an array of tuners 44 for tuning the primary transverse coils 13, and the outputs of the tuners 44 are fed along leads 45 to an array of five primary double comparators 46. The comparators 46 are arranged in a formation corresponding to the comparators 32 already described and are arranged to produce a one-out-of-five response along five output lines 147 which indicates which of the five primary coils 13P1, 13P2, 13P3, 13P4 and 13P5 is closest to the wand 14.

The outputs on the leads 147 are fed to five clamp circuits 146 which are controlled by the secondary-set signal on the lead 37' from the synchroniser unit 35 in FIG. 2. The clamp circuits 146 are arranged in such a manner as to clamp at zero the outputs of the comparators 146 during the half period when the secondary coils 13' are enabled by the secondary-set signal closing the relays 41'. The purpose of this clamping is to avoid spurious signals leaving the comparators 46 during this half period when the primary coils 13 are not enabled.

The outputs of the clamp circuits 146 are fed along leads 47, and the signals on the leads 47 are fed through a side circuit to a five entry OR gate 48 corresponding to the four entry OR gate 34 already mentioned. The output of the OR gate 38 is fed to the wand driver unit 27 in FIG. 2 along the lead 50.

It will be appreciated that there are provided an array of tuners 44' corresponding to the tuners 44 to process signals from the secondary coils 13' and the outputs of the tuners 44' are fed along leads 45' to comparators 46' which provide outputs on leads 147'. Corresponding clamp circuits 146' then provide outputs on leads 47'. A five entry OR gate 48' is provided corresponding to the OR gate 48 and the output of the OR gate 48' is fed along a lead 50' which is connected to the lead 50 and fed to the wand driver unit 27 (FIG. 2).

The main output route from the clamp circuits 146 and 146' is along the leads 47 and 47' to an array of five stage primary and secondary shift registers 51 and 51' situated in the shift register unit 23 and which will now be described with reference to FIG. 10. The four five-stage primary shift registers 51 are designated shift registers 51A, 51B, 51C and 51D. The outputs along the lines 47 are connected in the five stages of each shift register 51 as shown. The input signals to the primary shift registers 51 are designated pre-set signals 1 to 5 and are registered by the shift registers 51 when the shift registers 51 receive primary enabling signals fed from the shift register entry control unit 24 along leads 52 to the enabling inputs for the shift registers 51.

Each of the shift registers 51 also receives a signal designated shift-primary-and-final along the lead 53 from the synchroniser unit 35. This signal acts as a shift signal for both the primary shift registers 51 and for a bank of final shift registers 55. The purpose of this signal along the lead 53 is to step the primary and final shift registers 51 and 55 in unison half-way through the secondary enable period defined by the secondary set signal on the line 37 in FIG. 2. An interleaved signal along the lead 53', designated shift secondary signal, steps the secondary shift registers 51' half-way through the primary enable period set by the primary set signal on the lead 37 in FIG. 2.

The secondary shift registers 51'A, 51'B, 51'C and 51'D are correspondingly connected to receive the outputs of the secondary logic circuits 21' along the leads 47' and are controlled by enable signals 52' from the shift register entry control unit 24. The output of each of the primary shift registers 51 is fed along a lead 54 individual thereto to one of the five-stage final shift registers 55 individual thereto. There are four final shift registers 55A, 55B, 55C and 55D corresponding to the four primary shift registers 51.

The outputs of the secondary shift registers 51' along the leads 54' are fed directly into the pre-set inputs to the first stages of the final shift registers 55. This is in contrast with the outputs of the primary shift registers 51 along the leads 54 which are fed into the serial inputs of the first stages of the final shift registers 55. This staggered input from the secondary shift registers 51' relative to the primary shift registers 51 takes account of the staggered position of the secondary coils 13' relative to the primary coils 13 and allows the outputs of the primary and secondary coils 13 and 13' to be combined in the final shift register 55 by, in effect, interleaving the outputs of the coils 13 and 13'. Thus the outputs of the two sets of primary and secondary shift registers 51 and 51' are half a stage out of step and this is corrected by the connections at the first stage of each of the final shift registers 55. The leading signals on the leads 54 are connected to the serial inputs and the lagging signals on the lines 54' are directly entered into the pre-set inputs. (The terminology used in this specification is intended to indicate that the serial input of a shift register is that information present at the serial input and is only entered into the first stage when this register is shifted by a shift signal. Information at a pre-set input of a shift register can be entered at any time by a coincidence signal applied to the pre-set enable input.) Thus the final shift registers 55 produce alignment of the two sets of data and also add a further delay to allow the matrix of coils 20 to be set back from the discharge point at the end of the conveyor 11 (FIG. 1).

Each of the final shift registers 55 is enabled by a signal designated enable-final fed along the lead 57 from the shaft register entry control unit 35 in FIG. 2. The final enabling signal has the function of triggering the addition of the information from the last stages of the secondary shift registers 51' presented at the first pre-set inputs of the final shift registers 55 to the information fed to the final shift registers 55 from the primary shift registers 51 and presented at the serial inputs of the final shift registers 55 so as to effect the necessary alignment.

The overall object of the shift register unit 23 is to provide at the outputs of the final shift registers 55 a set of one or more output signals on four output leads 56 such that the timing of these output signals is adjusted to coincide with the arrival at the reject units 60 of the conveyor 11 (FIG. 1) of the object or objects which have been indicated by the wand 14.

The determination of which of the final shift registers 55 indicate reject signals is determined by the enabling signals along the leads 52 and 52' from the shift register entry control unit 24 (dependent on channel choice). The timing of the output signal or signals on the leads 56 relative to the movement of the conveyor 11 is determined by the pre-set and serial inputs to the shift registers 55 (dependent on transverse coil choice).

The outputs of the final shift registers 55 along the leads 56 are fed to the set of four output amplifiers comprising solenoid thyristor drive units 58 which in turn feed outputs of approximately 40 to 50 volts along leads 18 in FIGS. 1 and 2 to the actuators 19 in FIGS. 1 and 2.

Thus to summarize the operation of the control means 17, it is arranged to receive the signals generated in the coil matrix 20 by the wand 14; to decode these signals so as to define on the site array the position at which the operator has selected an object by energising the oscillator in the wand 14; to introduce delay corresponding to the transit time of the selected object from the point at which it was selected to the point at which it will be separated from the non-selected objects; and finally to operate the corresponding actuator 19 in order to effect separation. Thus each of the final shift registers 55 is arranged to give an output signal to an associated amplifier 58 when a selected object on the associated channel of the conveyor 11 reaches the associated actuating device 60. The output amplifier 58 then passes an actuating signal to the associated one of the actuators 19 which drives the rejector mechanism 60.

In a modification of the embodiment illustrated, the transverse sets of coils 13 and 13' may be switched into a single set of tuners 44 by changeover relays in place of the relays 41 and 41' (FIG. 13). The single set of outputs thus achieved may be fed via the comparators 46 and the clamp circuits 146 into either a set of single shift registers in place of the primary and secondary shift registers shown in FIG. 10, or alternatively (as shown in FIG. 13) may be fed together with the signals from the longitudinal coils 10 via the comparators 32 and the clamp circuits 132 into a random-access memory arranged to provide a similar delay to that provided by the shift registers shown in FIG. 10.

In FIG. 11 there is shown diagrammatically a side view of one of the actuator members 60. As has been described with reference to FIG. 1, the rollers 61 of the conveyor 11 are carried by side chains trained round sprockets 64. Each plunger 63 is mounted in a housing 70 and inclined so that upon actuation of the plunger 63 it projects rapidly through a gap between two rollers 61 and ejects an unwanted object. The plunger 63 may, for example, have a stroke of three inches and is arranged to operate sufficiently rapidly to allow the plunger 63 to project between rollers 61 and to retract again before the edge of the next roller 61 comes up against the plunger 63. Typically about 50 milliseconds is available for this purpose.

This arrangement has a number of advantages compared with known separating devices. For example in known X-ray separators for potato harvesters a bank of deflecting fingers is actuated so as either to deflect potatoes to a container or to allow stones to fall to the ground. An advantage of the rejector arrangement shown in the present figures is that rejection of unwanted objects takes place while the objects are still being positively transported by the conveyor means in the same manner as when the selection is carried out over the matrix of coils 20. In the previously known arrangements mention above where the objects are separated during free fall, errors can arise due to variation in the time taken for a falling object to reach the rejection area. The manner of falling of the objects often varies depending on the shape of the objects and the way in which they fall over an end roller. It will be appreciated however that in some applications of the present invention a free fall type of separating means may be used.

FIG. 12 shows in diagrammatic form one ejection mechanism which may be used for operating the plungers 63 of FIG. 11. In order to drive the plungers 63 there is provided in the example shown a cross head 68 moving in slide bearings 69 and arranged to reciprocate in synchronism with the travel of the belt 11. The cross head 68 is driven by a crankshaft 72 and is arranged to reciprocate in synchronism with the travel of the conveyor 11. Each plunger 63 is carried in the housing 70 individual thereto which allows the rod 63 to swivel so as to bring the end of each plunger 63 either into or out of line with slots 71 and out of or into contact with the cross head 68. Each of the housings 70 is connected by a connecting rod 79 individual thereto to an associated one of the actuators 19 which may for example be an electromagnetic solenoid. For simplicity in FIG. 12 only one of the con-rods 79 and actuators 19 is shown. Thus the swivelling action of the housing 70 is determined under the control of the actuators 19 as shown in FIG. 1. When a rod 73 is swivelled so as to be in line with the cross head 68, the next forward movement of the cross head 69 carries the plunger 63 rapidly through the associated gap between rollers 67 and ejects the unwanted object. Each of the plungers 63 is spring loaded to its withdrawn position by a spring indicated diagrammatically at 73', and each of the housings 70 is biassed towards the angled position by spring means indicated diagrammatically at 73, so that the rods 63 are returned to the angled, withdrawn position after the actuator 19 is de-energized. (For simplicity only one of the springs 73 is shown). Those plungers 63 which are not actuated at any one time are swivelled to the angled position shown such that at the next forward movement of the cross head 69 the plungers 63 concerned enter the associated slots 71. To ensure rapid action only the last part of the travel of the cross head 68 is utilised. The signals for actuating the actuators 19 are arranged to occur during that part of the cycle when the cross head 68 is at its rearmost position.

In a development of the embodiment described there may be provided more than one wand for use with the matrix 20 of coils. It is envisaged that an operator will be able to employ both hands each carrying a wand. Clearly if both wands are energised simultaneously in contact with objects, co-ordinate points will be identified at the intersections forming the alternate corners of the rectangle diagonally located by the two wands. This can be prevented by alternate energising of the wands or where two inspection areas adjoin across a wide belt with two wands in each area, the four wands then employed (by two operators) will have their power supply sequentially switched to avoid cross-talk between areas in addition to the false co-ordinates already mentioned.

A further possibility is the introduction of a frequency modulated oscillator in the wand to allow the operator to transmit information to the separator means as to a destination of an object selected from more than two possibilities.

Other arrangements which may be used include the use of a battery operated selector member unattached by cables. This involves a further inductive loop transmission from the control means 17 to the selector member 14 to call up an appropriate wand signal.

An embodiment such as has been described finds use (for example) in potato handling at two stages of production. Firstly the use may be in a complete harvester where at present fully manual or entirely automatic separation is performed to remove the stones and clods from the potatoes, and secondly in an indoor store at a later stage when potatoes are being prepared for sale and damaged tubers are to be removed. Another application of the invention occurs in egg candling, although the separation in such an arrangement must obviously be by gentler form of separator (such as the known inclined separator fingers) rather than by the plunger ejector shown in the figures.

I claim:

1. Sorting apparatus comprising locating means for defining an array of selectable sites and for generating for each site when selected a signal or signals identifying that site, conveying means for conveying past the array of sites objects to be sorted by selection by an operator, separating means for separating selected and unselected objects, the locating means including a movable selector member for selecting objects as they pass the array of sites by causing site-identifying signals to be generated in respect of sites corresponding to the objects selected, the separating means being connected to an output of the locating means for actuating the separating means in dependence upon site-identifying signals generated by the locating means.

2. Apparatus according to claim 1 in which the selector member comprises a rod-like member adapted to be hand held for indicating selected objects.

3. Apparatus according to claim 1 in which the locating means is arranged to be actuated by operation of a pressure switch on the selector member.

4. Apparatus according to claim 1 in which the separating means comprises a bank of rejector members positioned beneath the conveying means and arranged to project through the conveying means when actuated by the locating means so as to strike a selected object and to eject it from the conveying means.

5. Apparatus according to claim 1 in which the separating means is spaced from the array of selectable sites and the conveying means is arranged to convey the objects to be sorted from the array of sites to the separating means.

6. Apparatus according to claim 5 in which the locating means includes a memory device for storing information concerning a selected object when the object passes the array of sites and for presenting this information again after an appropriate delay when the object reaches the separating means, the locating means being arraged to utilise the stored information to control the separating means after the said delay.

7. Apparatus according to claim 6 in which the said memory device comprises at least one shift register.

8. Apparatus according to claim 6 in which said memory device comprises a random access memory.

9. Apparatus according to claim 1 in which the locating means includes a plurality of coils for receiving electrical signals transmitted by the selector member, the coils being positioned in the region of the conveying means and being arranged to define the said array of sites.

10. Apparatus according to claim 9 in which the conveying means is arranged to convey the objects over the plurality of coils.

11. Apparatus according to claim 9 in which the coils are arranged in a matrix of sets of orthogonal coils defining the array of sites by the intersections of the orthogonal coils, the matrix comprising longitudinal coils arranged along the general direction of movement of the conveying means, and transverse coils arranged across the general direction of movement of the conveying means.

12. Apparatus according to claim 11 in which the conveying means includes dividing means defining a plurality of channels running along the length of the conveying means and positioned in register with the longitudinal coils of the coil matrix, the longitudinal dividing means being adapted to position the objects to be sorted over and in register with the longitudinal coils.

13. Apparatus according to claim 11 in which the separating means is spaced from the array of selectable sites and the and the conveying means is arranged to convey the objects to be sorted from the array of sites to the separating means, the locating means including a memory device for storing information concerning a selected object when the object passes the array of sites and for presenting this information again after an appropriate delay when the object reaches the separating means, the locating means being arranged to utilise the stored information to control the separating means after the said delay and said memory device comprising at least one shift register connected to be shifted in synchronism with the movement of the conveying means past the transverse coils of the coil matrix and connected to receive at different pre-set inputs of the stages of the shift register input signals derived from different transverse coils of the matrix of coils.

14. Apparatus according to claim 13 in which the locating means includes a plurality of shift registers arranged with at least one shift register associated with each of the longitudinal coils of the matrix, and entry control means for controlling entry of information into the shift registers in dependence upon output signals derived from the longitudinal coils.

15. Apparatus according to claim 11 in which the matrix of coils includes a plurality of sets of transverse coils, the transverse coils of different sets being staggered in position along the general direction of movement of the conveying means.

16. Apparatus according to claim 15 in which the locating means includes delay means for delaying output signals from the transverse coils of one of the sets of transverse coils relative to output signals from other transverse coils, and for combining output signals from transverse coils of different sets of transverse coils.

17. Apparatus according to claim 15 in which the conveying means includes dividing means defining a plurality of succeeding transverse rows across the conveying means having a spacing equal to the spacing of transverse coils of the same set, the dividing means being adapted to position the objects to be sorted in transverse rows across the conveying means.

18. Apparatus according to claim 15 in which the matrix of coils includes two sets of transverse coils, the transverse coils of one set being displaced relative to the transverse coils of the other set along the general direction of travel of the conveying means by half a pitch of the transverse coils of one set.

19. Apparatus according to claim 18 in which the locating means includes switching means for rendering different sets of coils active to produce output signals at different times in a regularly recurring sequence.

20. Apparatus according to claim 19 in which the switching means is arranged to render the two sets of transverse coils active alternately with a period of alternation equal to the period of movement of the conveying means past successive transverse coils of one set of transverse coil.

21. Apparatus according to claim 20 in which the locating means includes delay means for delaying the output signals from the coils of the leading set of transverse coils relative to the output signals of the coils of the lagging set of transverse coils by half the period of movement of the conveying means past successive transverse coils of one set of transverse coils, and for combining output signals from transverse coils of different sets of transverse coils.

22. Apparatus according to claim 21 in which the delay means includes at least one shift register and the delay is produced by feeding output signals from a coil of the leading set of transverse coils into a serial input of a shift register and by feeding output signals from a corresponding coil of the lagging set of transverse coils into a preset input of the shift register.

* * * * *